US006595867B2

(12) United States Patent
Sosin

(10) Patent No.: US 6,595,867 B2
(45) Date of Patent: Jul. 22, 2003

(54) BLOCK PUTTER

(75) Inventor: Howard Sosin, Fairfield, CT (US)

(73) Assignee: Feil Golf, LLC, Fairfield, CT (US)

( * ) Notice: Subject to any disclaimer, the term of this patent is extended or adjusted under 35 U.S.C. 154(b) by 0 days.

(21) Appl. No.: 09/943,364

(22) Filed: Aug. 30, 2001

(65) Prior Publication Data

US 2002/0025860 A1 Feb. 28, 2002

Related U.S. Application Data

(63) Continuation-in-part of application No. 09/874,658, filed on Jun. 4, 2001, now abandoned, which is a continuation-in-part of application No. 09/851,050, filed on May 8, 2001, now abandoned, which is a continuation-in-part of application No. 09/650,563, filed on Aug. 30, 2000, now abandoned.

(51) Int. Cl.[7] ..... A63B 53/00; A63B 53/04

(52) U.S. Cl. ..... 473/290; 473/293; 473/294; 473/313; 473/340; 473/409

(58) Field of Search ..... 473/294, 212, 473/208, 207, 296, 293, 300, 409, 256, 325, 313, 340, 341, 287, 288, 289, 290, 291

(56) References Cited

U.S. PATENT DOCUMENTS

| | | | | |
|---|---|---|---|---|
| 2,665,909 A | | 1/1954 | Wilson | |
| 3,319,962 A | | 5/1967 | Summers | |
| 3,333,854 A | * | 8/1967 | White | |
| 3,486,755 A | | 12/1969 | Hodge | |
| 3,679,207 A | * | 7/1972 | Florian | |
| 4,065,133 A | | 12/1977 | Gordos | |
| D247,791 S | | 4/1978 | Monteleone | D34/5 GH |
| 4,163,554 A | * | 8/1979 | Bernhardt | |
| 4,227,694 A | | 10/1980 | Drake | |
| 4,240,636 A | | 12/1980 | Swenson | |

(List continued on next page.)

FOREIGN PATENT DOCUMENTS

| | | | |
|---|---|---|---|
| GB | 1232375 | | 5/1971 |
| JP | 11-206938 | * | 8/1999 |

OTHER PUBLICATIONS

U.S. Golf Association (U.S.G.A.) Rules of Golf, 2000, Rules 4, 14, 16 and Appendix II.

*Primary Examiner*—Stephen Blau
(74) *Attorney, Agent, or Firm*—Choate, Hall & Stewart

(57) ABSTRACT

A block putter, usable with either a conventional or side-saddle putting stance for a right-handed or left-handed golfer, having a head width in the range of about one half to about twice the width of a golf ball. The increased width and potentially increased weight of the putter head improve its performance both on the green and when hitting from the fringe, the fairway, or the rough, or out of the sand. The golfer may use the toe of the putter, rather than one of the faces, to strike the ball, for increased accuracy, especially on short putts. Alternatively, the golfer may putt in a sidesaddle stance with the traditional putter face using a putter having an elongated shaft. The elongated shaft is of such a length as to allow for the end of the shaft to rest on the golfer's shoulder and help stabilize the putt.

14 Claims, 17 Drawing Sheets

U.S. PATENT DOCUMENTS

| | | | | | |
|---|---|---|---|---|---|
| 4,411,429 | A | | 10/1983 | Drew et al. | |
| 4,537,403 | A | | 8/1985 | Farina | |
| 4,592,552 | A | | 6/1986 | Garber | |
| 4,756,535 | A | * | 7/1988 | Bradley | |
| 5,127,653 | A | | 7/1992 | Nelson | |
| 5,328,185 | A | | 7/1994 | Finnigan et al. | |
| 5,346,219 | A | * | 9/1994 | Pehoski | |
| 5,382,019 | A | | 1/1995 | Sneed | |
| 5,417,429 | A | | 5/1995 | Strand | |
| D359,330 | S | | 6/1995 | Channell | D21/217 |
| 5,447,313 | A | | 9/1995 | Finley | |
| 5,454,564 | A | | 10/1995 | Kronogard | |
| 5,458,332 | A | * | 10/1995 | Fisher | |
| 5,460,378 | A | * | 10/1995 | Getts | |
| 5,520,392 | A | * | 5/1996 | Foresi | |
| D375,131 | S | | 10/1996 | Williams | D21/219 |
| 5,584,769 | A | * | 12/1996 | Sundin | |
| 5,597,364 | A | | 1/1997 | Thompson | 473/314 |
| 5,624,329 | A | * | 4/1997 | Schneebeli | |
| 5,649,870 | A | | 7/1997 | Harrison | 473/239 |
| 5,792,007 | A | * | 8/1998 | Billings | |
| 5,830,087 | A | * | 11/1998 | Sullivan | |
| 5,921,871 | A | * | 7/1999 | Fisher | |
| 5,976,025 | A | * | 11/1999 | Williams | |
| 5,997,408 | A | * | 12/1999 | Bankhead | |
| 6,039,657 | A | * | 3/2000 | Gidney | |
| 6,048,275 | A | | 4/2000 | Gedeon | 473/293 |
| 6,186,904 | B1 | * | 2/2001 | Bass | |

* cited by examiner

BLOCK PUTTER

RELATED APPLICATIONS

The present application is a Continuation-in-Part of co-pending application Ser. No. 09/874,658 filed Jun. 4, 2001, now abandoned which itself is a Continuation-in-Part of co-pending application Ser. No. 09/851,050 filed May 8, 2001 now abandoned which itself is a Continuation-in-Part of co-pending application Ser. No. 09/650,563 filed Aug. 30, 2000, now abandoned the teachings of all of which are hereby incorporated by reference.

FIELD OF THE INVENTION

The present invention relates to golf putters, and particularly to a golf putter usable with either a conventional or "sidesaddle" putting stance by a right-handed or left-handed golfer.

BACKGROUND OF THE INVENTION

Putting accounts for nearly half of the total strokes in a game of golf. Most golfers putt using a conventional stance in which the golfer addresses the ball, basically standing so he is facing at right angles to the line to the hole. Usually a golfer will choose the line of his putt while facing the hole, and then will turn about 90° to assume his stance. The act of turning can make it difficult to continue to see the line, which can cause putts, especially short putts, to be unsuccessful because they are not hit on the line.

In order to face the hole (or target on a breaking putt) during both the "lining up" and "execution" phases of the putting stroke, some golfers have adopted a "sidesaddle" putting stance. For this stance, the golfer stands to one side of the ball and faces the hole. (The precursor of the sidesaddle stance was the "croquet style" stance, in which the golfer stands astride the line from the ball to the hole and swings the club between his legs. This putting technique is now specifically forbidden by the U.S. Golf Association (U.S.G.A.) Rules of Golf, Rule 16-1e). FIG. 1 is a photograph of Sam Snead, perhaps the most famous golfer to use the sidesaddle stance.

In the sidesaddle stance, the golfer generally leans over the ball and tries to place his eyes in the vertical plane of the ball and the target. This is difficult with a conventional putter, because the putter is constructed so that the shaft is at an angle of at least 10° to the vertical when the sole of the putter is on the ground. (This angle is required by Appendix II of the 2000–01 U.S.G.A. Rules, Part 1d(i), which states that "the projection of the straight part of the shaft on to the vertical plane through the toe and heel shall diverge from the vertical by at least 10 degrees"). The required angle also makes it difficult for a golfer to position his hands in the vertical plane of the ball and the hole.

In U.S. Pat. No. 4,592,552, incorporated herein by reference, Garber discloses a putter designed to be used either in a conventional or sidesaddle stance. The putter has a head generally in the form of a right triangle, with two putting surfaces. A larger surface is intended to be used for longer putts in a conventional stance, and a smaller surface at right angles to the larger surface is intended to be used for shorter putts in a sidesaddle stance. As noted in U.S. Pat. No. 6,039,657 to Gidney, the Garber putter design probably does not conform to the U.S.G.A Rules of Golf ("The clubhead shall have only one striking face, except that a putter may have two such faces if their characteristics are the same, and they are opposite each other," Id., Appendix II, Part 4c).

Furthermore, the asymmetry of the putter head makes it somewhat awkward to swing, since its center of mass may not lie along the line of the shaft. In addition, left-handed golfers must use a separate putter.

A need still exists for a putter having two identical putting faces opposite to one another that can conveniently be used from either a conventional or a sidesaddle stance, by both left-handed and right-handed golfers, and a method and device for sidesaddle stance putting that promotes a stable and consistent putting stroke.

SUMMARY OF THE INVENTION

In one aspect, the invention comprises a "block" putter having a shaft and a substantially symmetric head, where the head has a width in the range of about half the width of a regulation golf ball to about twice the width of a regulation golf ball. The club is preferably in conformance with the 2000–01 U.S.G.A. Rules of Golf, which are incorporated herein by reference. The head of the putter is more preferably in the range of about ¾ times the width of a golf ball to about 1¼ times the width of a golf ball, and most preferably of about the same width as a golf ball. The sole of the putter may be curved from front to back, from side to side, or both. The shaft may be bent in the direction of the heel of the putter. The putter head may have a weight in the range of about 200 to about 500 grams, or preferably about 250 to about 350 grams. A vertical channel may be cut into the putter head (e.g., to reduce weight). The shaft may have a length of at least about 40 inches, or at least about 48 inches. The putter may further comprise a weight disposed on the shaft. Such a weight may, for example, shift the center of mass of the putter to a point at or near the lower gripping hand in address position. Alternatively, the center of mass of the system of the putter and the swinging arm may be considered, and the weight may act to shift the center of mass of the system approximately to or above the position of the lower gripping hand, or approximately to the center of mass of the golfer's arm. The weight may have a mass in the range of about 50 to about 200 grams, or preferably in the range of about 100 to about 150 grams. The putter may further comprise one or more grips. The grips may have a relatively large diameter, such as at least about 1 inch, or at least about 1¼ inches.

In another aspect, the invention comprises a pair of matched putters, one for practice and one for competitive play. The practice putter head has a width of less than about half the width of a regulation golf ball, while the competition putter head has a width in the range of about half the width of a regulation golf ball to about twice the width of a golf ball. The matched putters have substantially the same center of mass and radius of gyration about the shoulder of the golfer's swinging arm. The heads of the two putters may have substantially the same mass. The head of the competition putter is more preferably in the range of about ¾ times the width of a golf ball to about 1¼ times the width of a golf ball, and most preferably of about the same width as a golf ball. The heads of the two putters may have the same vertical cross-section, or may be of the same shape, except for their width.

In another aspect, the invention comprises a method of putting that includes addressing a golf ball in a sidesaddle stance, swinging a putter having an elongated shaft, and controlling the putter during the putting swing from at least three points of contact. Generally, the putter will have a length between 40 and 84 inches such that the shaft of the putter extends above the shoulder of the golfer. The golfer grasps the putter with both hands and further stabilizes the putter by resting the elongated shaft on his shoulder.

BRIEF DESCRIPTION OF THE DRAWING

The invention is described with reference to the several figures of the drawing, in which.

DETAILED DESCRIPTION

Figure 1:
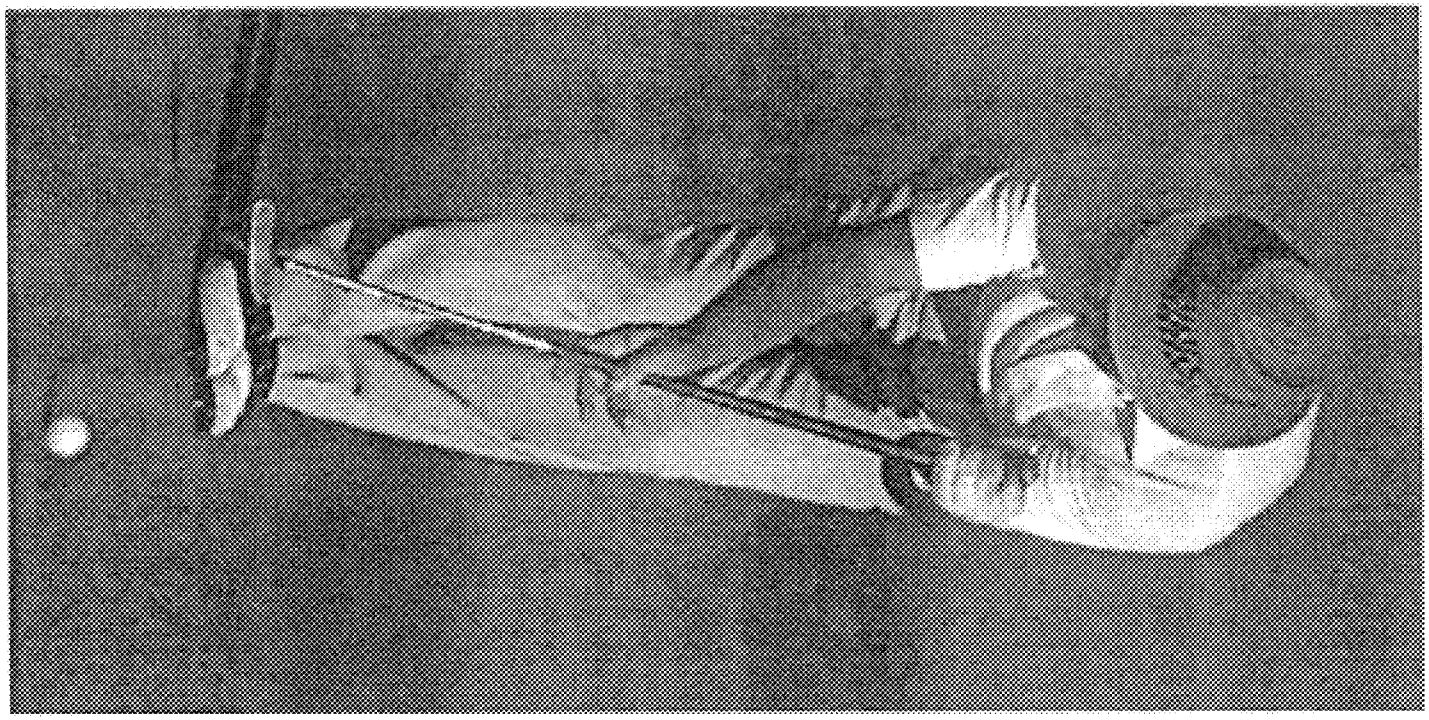
FIG. 1 Prior Art
FIG. 1 is a photograph of Sam Snead in a sidesaddle putting stance.
Figure 2A:
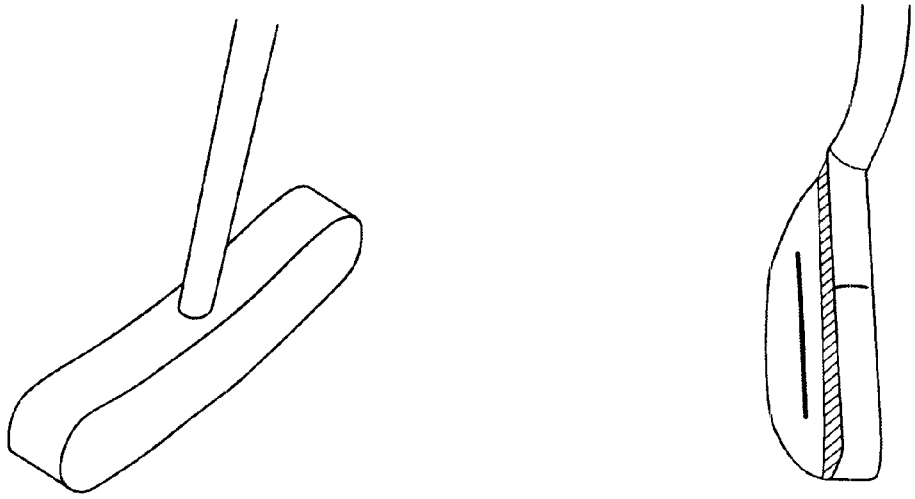
FIG. 2A Prior Art
FIGS. 2A–2C show the most common styles of putter heads.
Figure 2B:
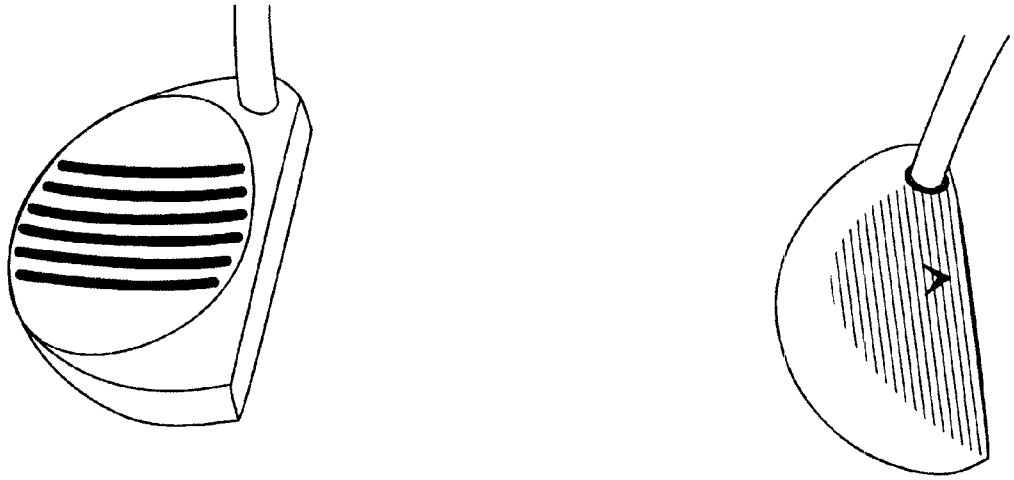
FIG. 2B Prior Art
Figure 2C:
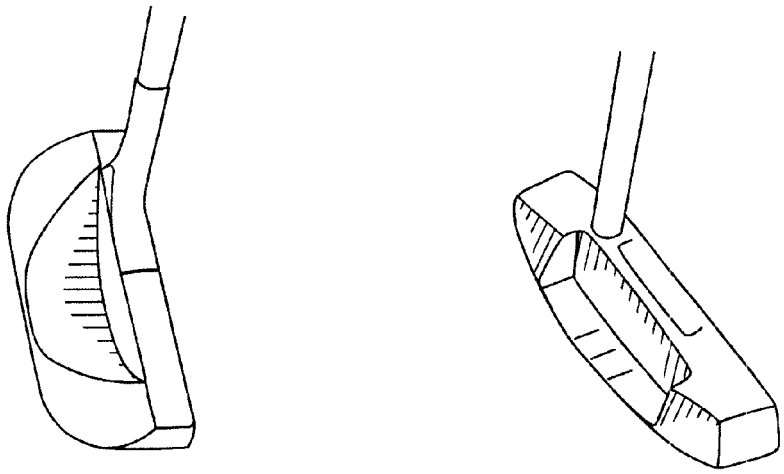
FIG. 2C Prior Art

"A putter is a club with a loft not exceeding ten degrees designed primarily for use on the putting green." Id., Appendix II, Part 1a. Putter heads come in three primary styles: blade putters, mallet putters, and perimeter weighted putters. FIG. 2A shows a blade putter that has symmetrical flat faces and may be used in either a right-handed or left-handed putting stance, as well as an asymmetric blade putter. FIGS. 2B and 2C show mallet putters and perimeter weighted putters, respectively, which may be asymmetric and which do not have the opposing identical faces of the first blade putter of FIG. 2A. A novel "block" putter head according to the invention is shown in perspective view in FIG. 3, and in front and side views in FIGS. 4A and 4B. From the side, the block putter head has a shape and curvature similar to that of a conventional blade putter, but the head is substantially wider. It is bilaterally symmetric like a blade putter, with two identical parallel putting faces. Traditionally, a blade putter is relatively narrow. Most commercially available blade putter heads have a thickness ranging from ¼ to ½ inch. However, I have found that a wider (and usually heavier) block putter head promotes a smooth conventional putting motion that needs only a short backswing.

Figure 5A:
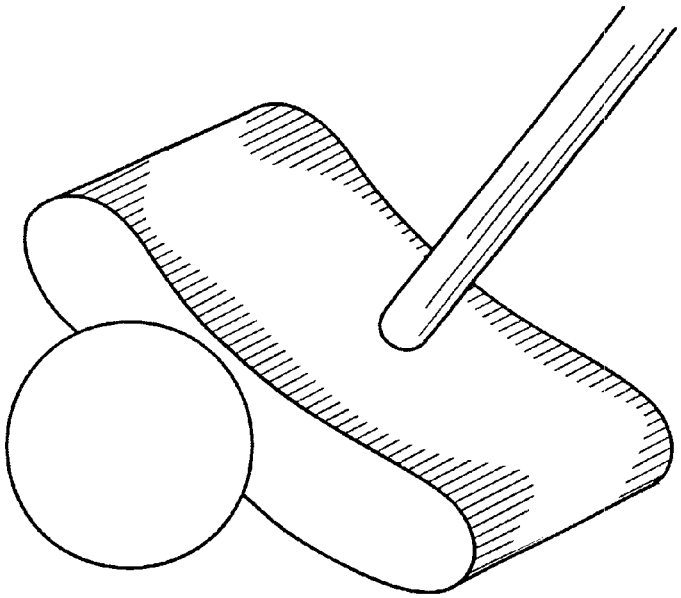
FIGS. 5A and 5B show ball position relative to the putter head for the conventional and sidesaddle stance according to the invention.
Figure 5B:
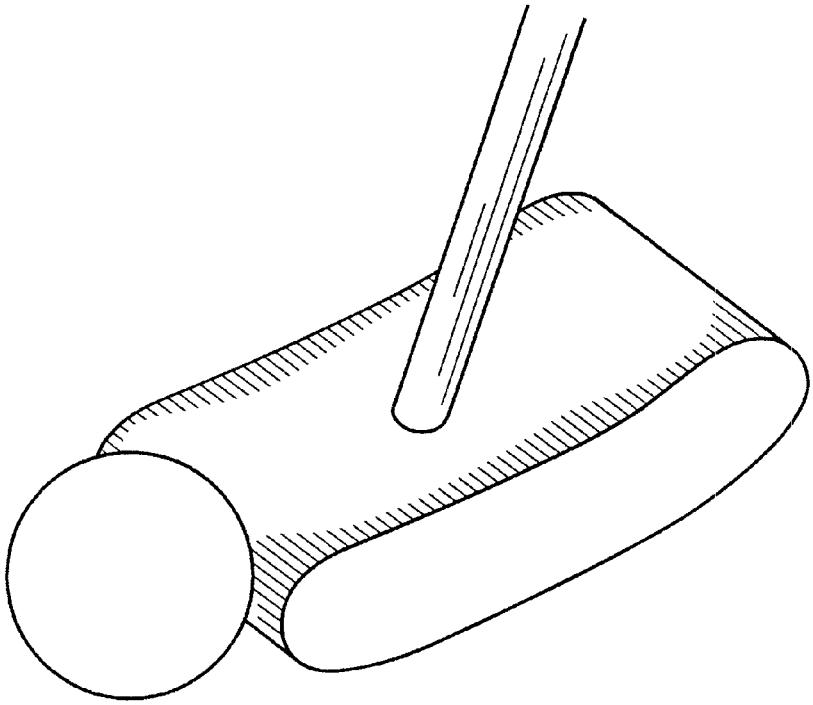

My new putter can be used in a conventional putting orientation shown in FIG. 5A, or in the novel orientation shown in FIG. 5B. I have found that remarkable control, especially for short putts, can be achieved by a sidesaddle stance with the putting orientation shown in FIG. 5B, because the golfer can easily see the ball and the hole from the address position shown in FIGS. 6A, 6B and 6C. The width of the putter allows it to be easily used in this novel fashion. The width of my putter is preferably in the range of about ½ to 2 times the minimum diameter of a regulation golf ball (1.68 inches), more preferably in the range of about ¾ to 1¼ times the minimum diameter of a regulation golf ball, and most preferably about the same width as the minimum diameter of a regulation golf ball.

Figure 6A:
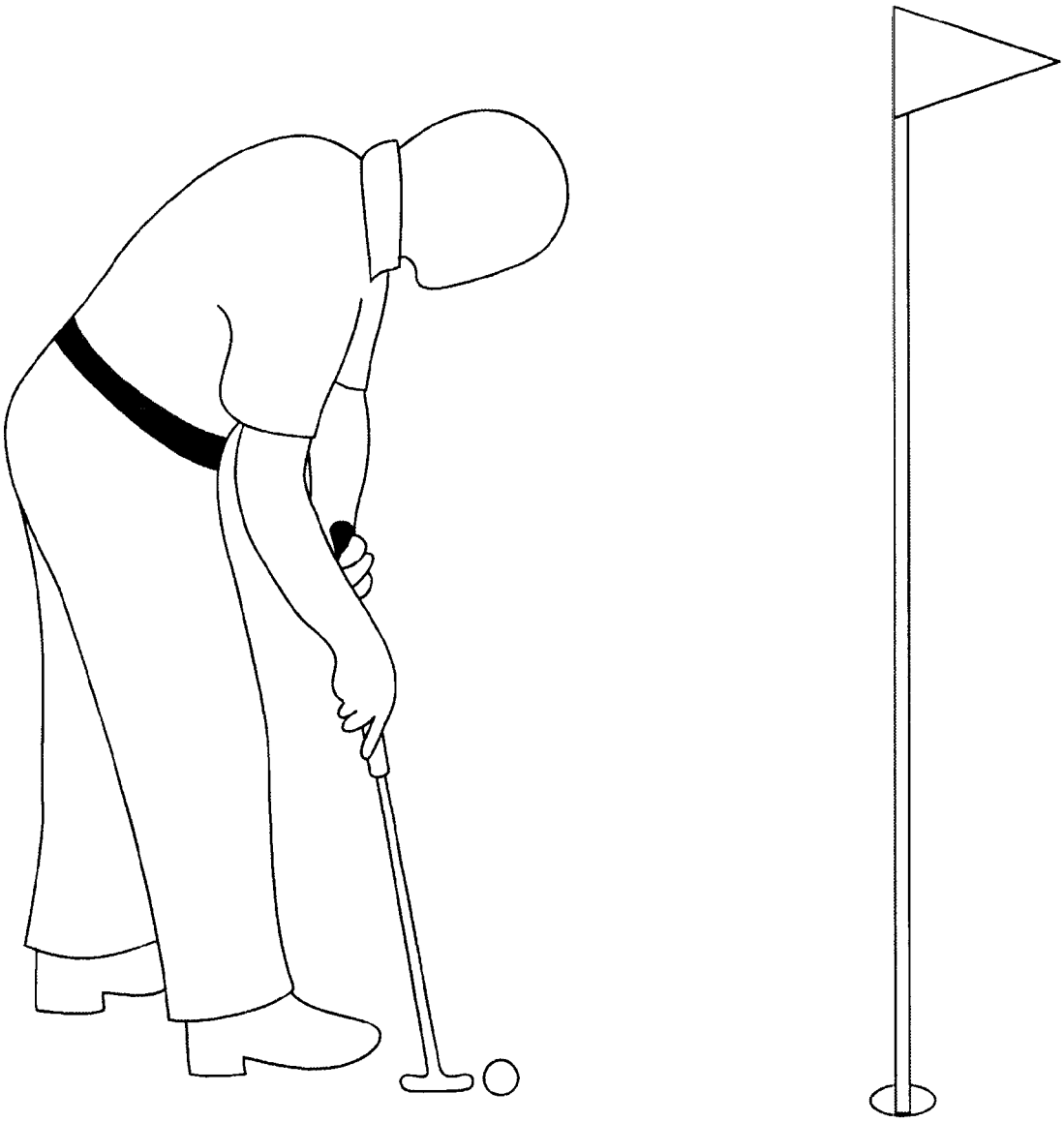
FIGS. 6A–6E show a golfer addressing the ball in a sidesaddle stance with putters having increasing shaft lengths according to the invention.
Figure 6B:
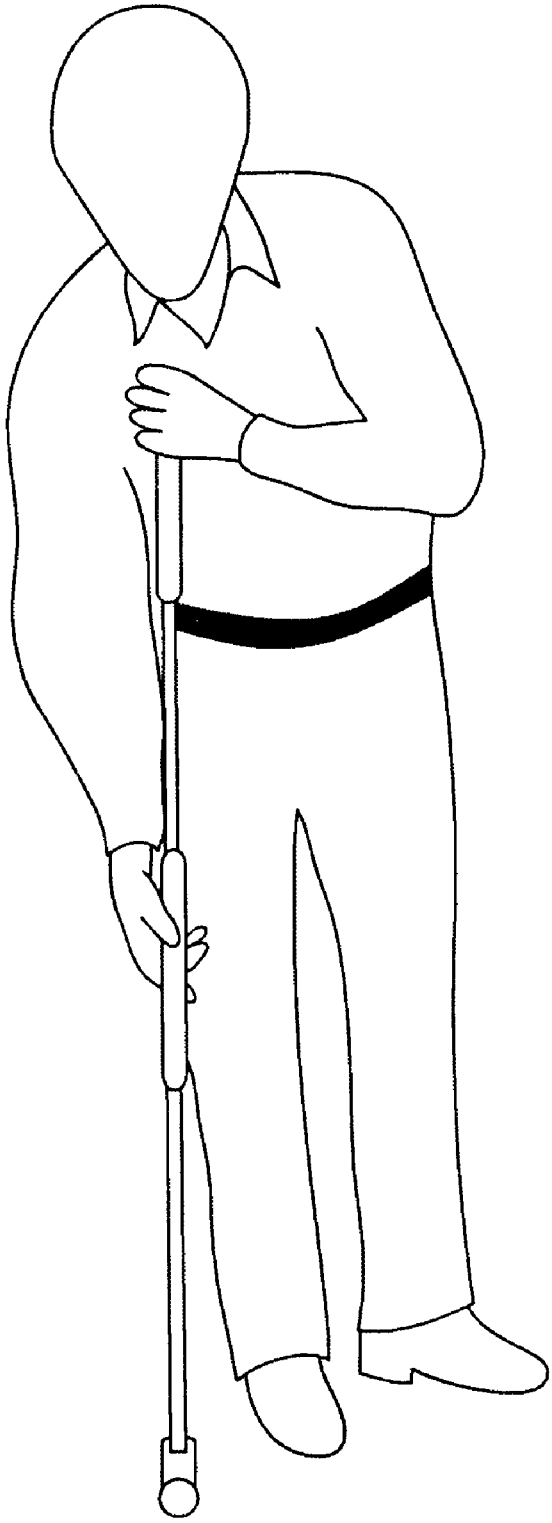
Figure 6C:
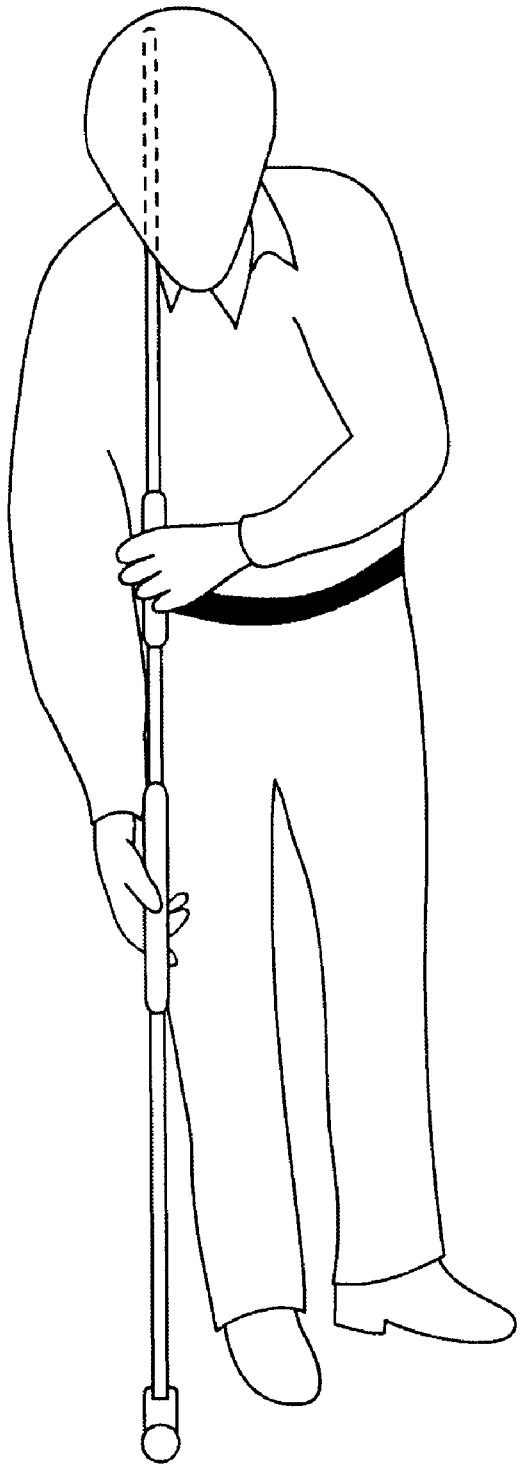
Figure 6D:
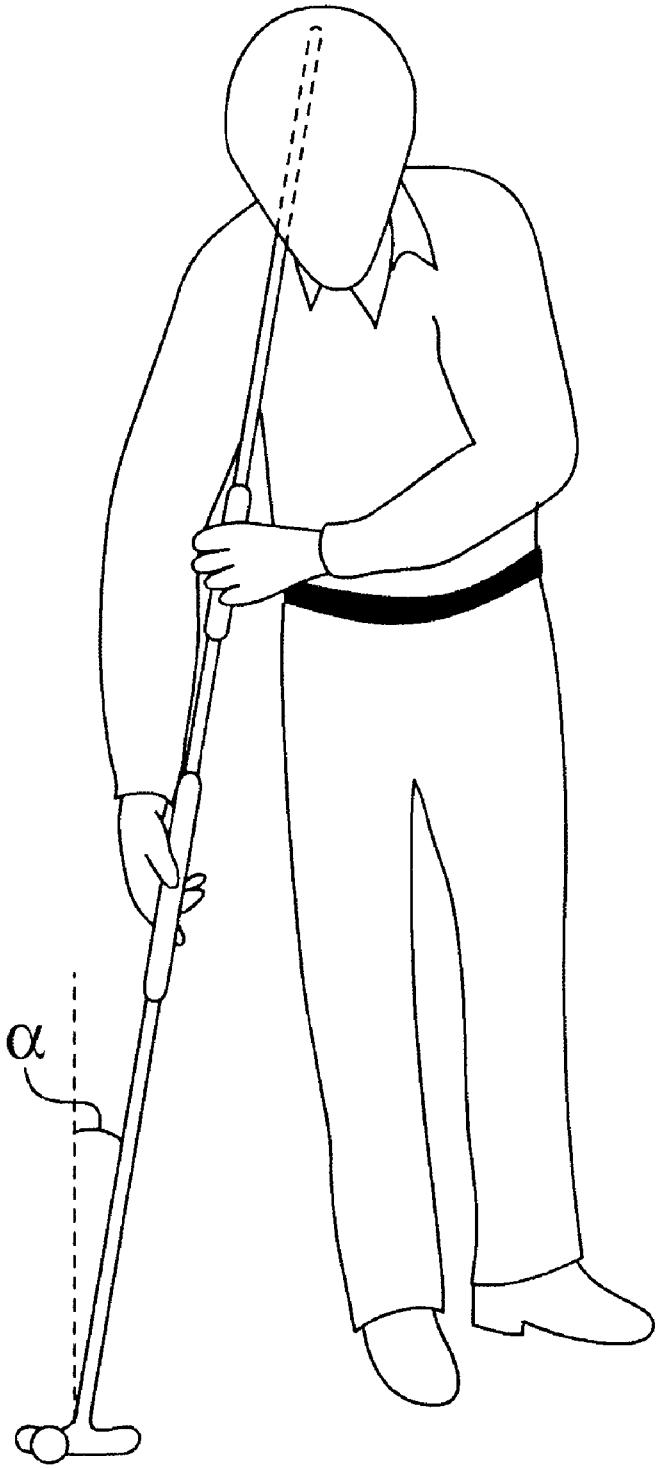
Figure 6E:
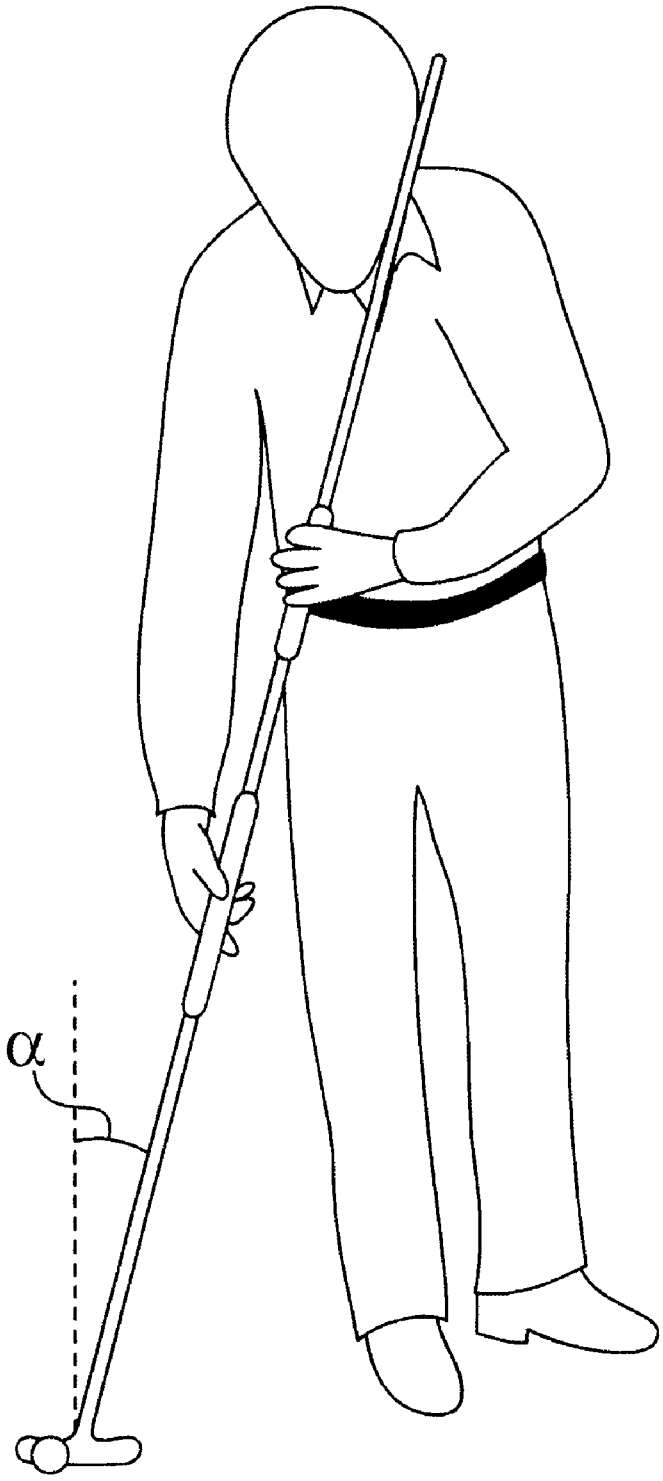

The shaft of the putter may either be of the more common length shown in FIG. 6A, or may be longer as shown in FIGS. 6B–6E. Some golfers find that the longer length shown in FIG. 6B gives more control, especially when putting in the sidesaddle stance. In an alternative embodiment, as shown in FIGS. 6C–6E, the shaft can extend beyond the shoulder of the golfer, perhaps by 3 to 12 inches. This would allow the golfer to rest the shaft against his shoulder and achieve greater stability of the putter and a better putting stroke. The stability arises because there are three points of control: each hand and the point where the shaft rests on the shoulder. A better putting stroke arises because if the hands operate such that the shaft continues to touch the shoulder at the designated point throughout the stroke, it is been found to be virtually impossible to bend or "breakdown" the wrists. Breakdown of the wrists results in an inconsistent putting stroke and can also be a source of the "yips"—a sudden and seemingly uncontrolled lunging at the ball with the putter. A putter according to the invention helps achieve a truer pendulum stroke and eliminates or ameliorates the problem of wrist breakdown and yips.

The advantages of the sidesaddle putting stance and elongated (or extended) shaft with multiple control points are seen both in the novel toe-putting style (see FIG. 5B) and the conventional face-putting style (see FIG. 5A). FIG. 6C illustrates the use of the invention with an elongated shaft when putting with the toe of the putter. FIG. 6D illustrates the use of the invention with an elongated shaft when putting more conventionally with the traditional face of the putter. When used in the manner shown in FIG. 6D, the projection of the straight part of the shaft onto the vertical plane through the toe and heel (shown as angle a) should be at least 10 degrees as required under Appendix II of the 2000–01 U.S.G.A. Rules, Part 1d(i). It should be noted that in this configuration, the plane containing the angle of the shaft with respect to the vertical axis is perpendicular to the target line. While conforming to the angle regulation for the shaft, a golfer may potentially tilt the putter within the plane perpendicular to the target line so that some or all of this angle disappears. Unlike with toe-putting, the putter and putting style shown in FIG. 6D will depend on the "handedness" of the player.

FIG. 6E illustrates an alternative embodiment for the use of the invention in which the point of shoulder contact and the extension of the elongated shaft occurs at the golfer's shoulder farthest from the golf ball during a putting swing, as opposed to the shoulder nearest to the golf ball. A golfer is free to determine which shoulder is most suited for any particular putt. This embodiment is equally applicable to toe-putting or conventional putting with the traditional face of the putter. In a preferred embodiment, the angle a shown in FIG. 6E can be between 10 and 45 degrees.

The putter head shown in FIGS. 6D and 6E need not have two parallel hitting surfaces. In fact the putter head used in this configuration can encompass any putter head and in particular any putter head that meets USGA specifications. In addition, the projection of the straight part of the shaft onto the vertical plane along the intended line of play can be customized depending on desired ball placement within the allowed angle of plus or minus 20 degrees.

The U.S.G.A. 2000–01 Rules, Appendix II, Part 3, govern grips for golf clubs. Grips may be tapered, but must not have any bulges or waists. Unlike other clubs, putters'grips may have a non-circular cross section, as long as the cross-section is symmetrical, had no concavity, and remains similar throughout the grip. Putters are also allowed to have two grips, as long as both are of circular cross-section. Finally, the grip for any club has a maximum diameter of 1.75 inches.

A putter according to the invention may have two grips, as can be seen in FIGS. 6B–6E. In addition, I have found that a wider than normal grip limits the use of the small muscles of the hand while putting, and thus may make it easier for the golfer to maintain a consistent putting technique. Putters according to the invention thus may have grip diameters of 1–1½ inches or more.

Figure 7A:
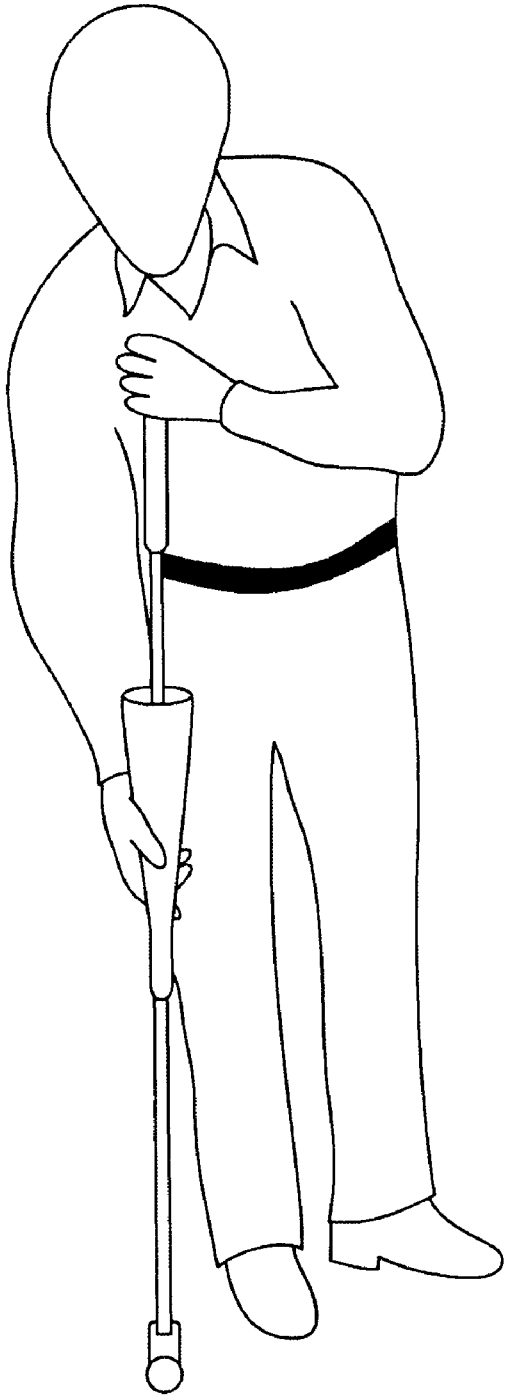
FIGS. 7A–7C show putters having widened grips according to the invention.
Figure 7B:
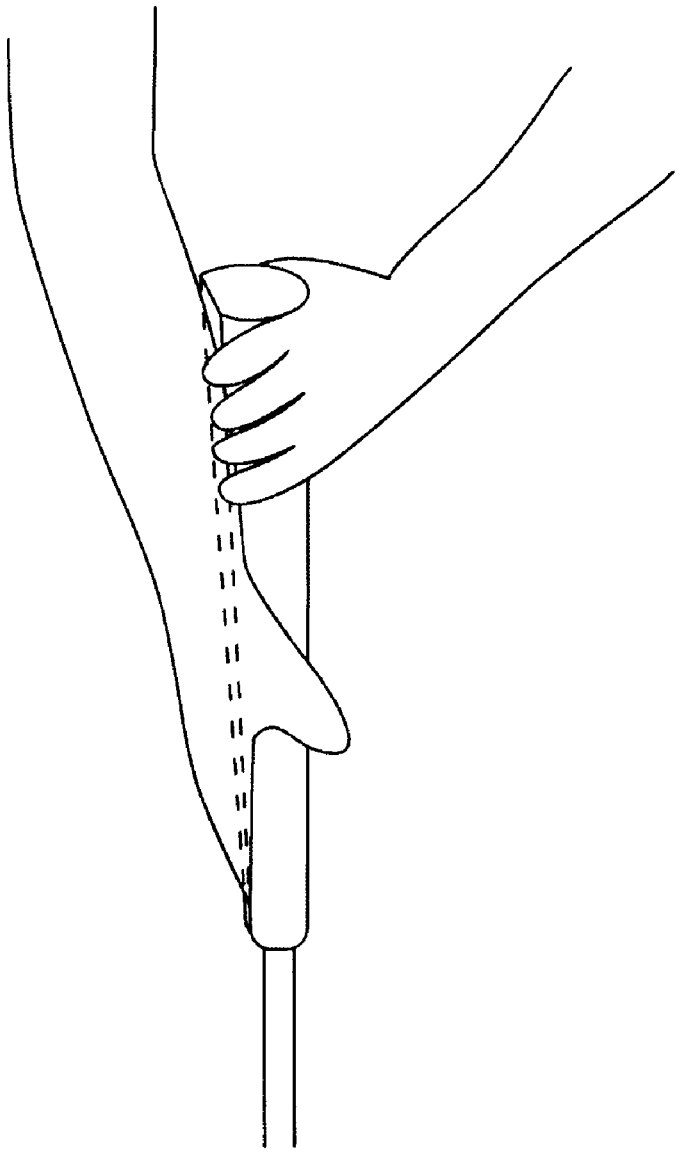
Figure 7C:
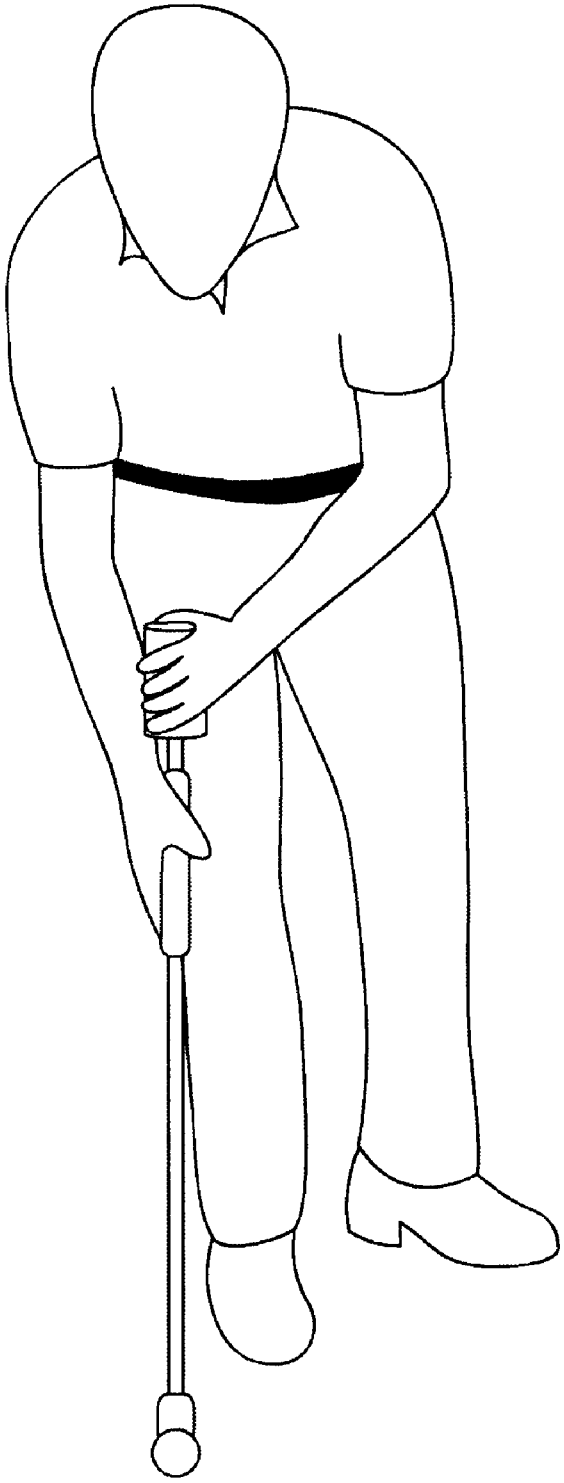

Further, accuracy (especially when putting with the toe of the putter) can sometimes be enhanced by choosing the diameter and shape of the grip so that it contacts the forearm of the swinging arm. For a two-grip putter, it may be desirable to make the lower grip with a relatively (4 large circular cross-section so that the putter can be "braced" against the forearm of the swinging arm, as shown in FIG. 7A. For a one-grip putter, the grip may also have a flat side where it rests against the arm, to further enhance its stability, as shown in FIG. 7B. This stability again helps to improve the putting stroke, for example, by preventing wrist break-down and yips. FIG. 7C illustrates a two-grip putter with the upper grip having a relatively large circular cross-section.

Figure 8:
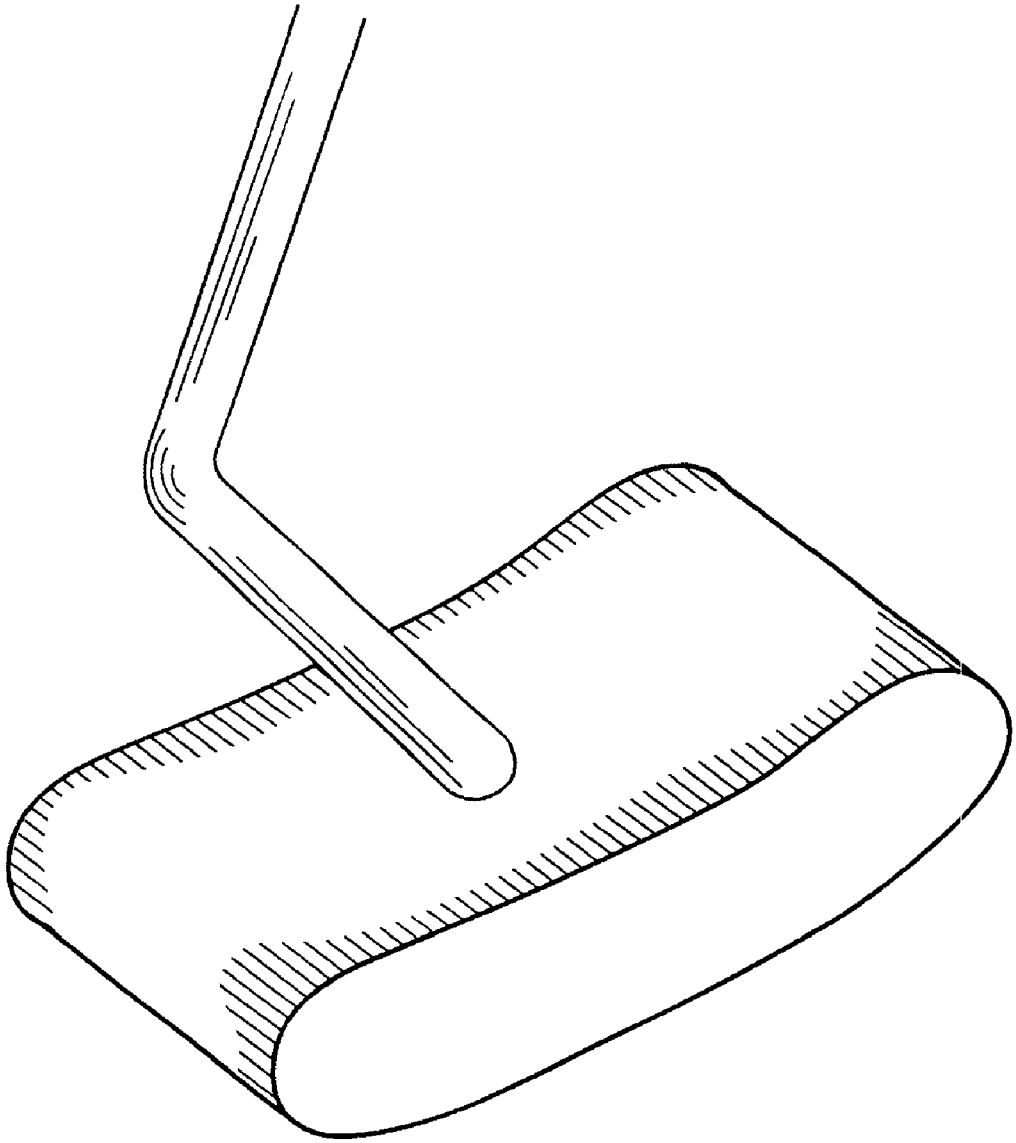
FIG. 8 shows a shaft having a bent neck.

The U.S.G.A. Rules of Golf provide that the shaft of the putter must form a 10° angle with the vertical when the sole of the putter is flat on the ground. This 10° angle can be mitigated somewhat by taking advantage of Rule 2(c) of Appendix II of the Rules, which states that "[t]he shaft shall be straight from the top of the grip to a point not more than 5 inches above the sole, measured from the point where the shaft ceases to be straight along the axis of the bent part of the shaft and the neck and/or socket." FIG. 8 shows the novel putter with a bent neck that minimizes the horizontal distance between the hands and the head of the putter.

Figure 9A:
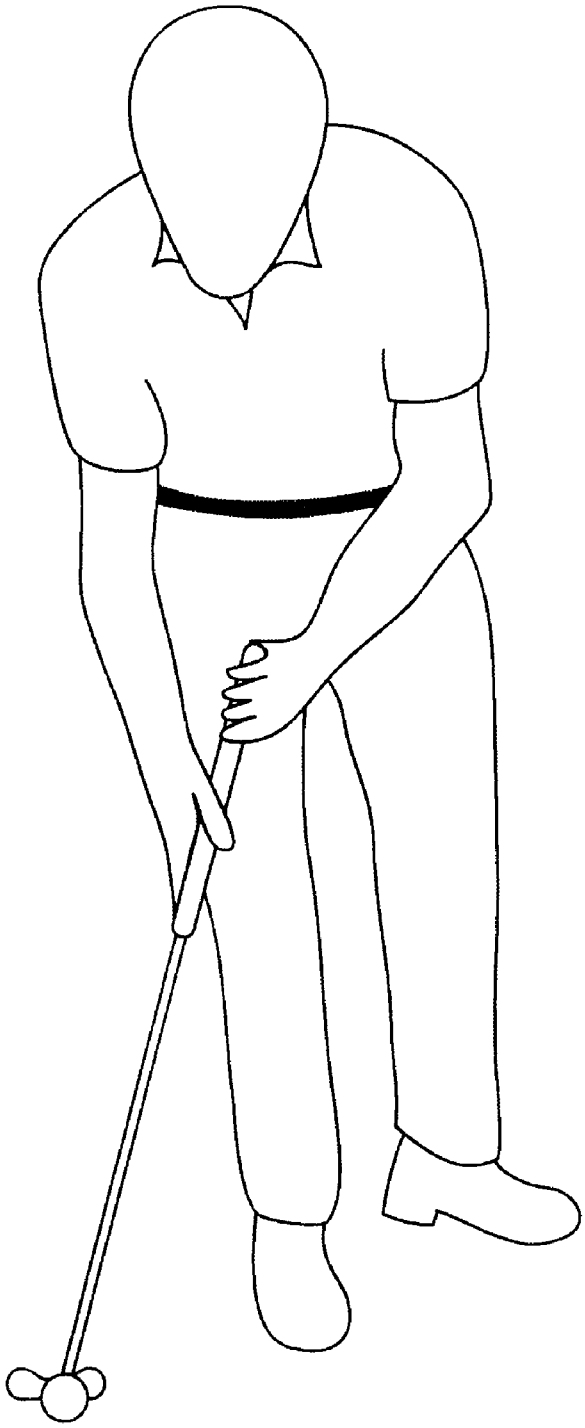
FIGS. 9A and 9B show a front view of a traditional sidesaddle putting stance and of a novel putting stance according to the invention.
Figure 9B:
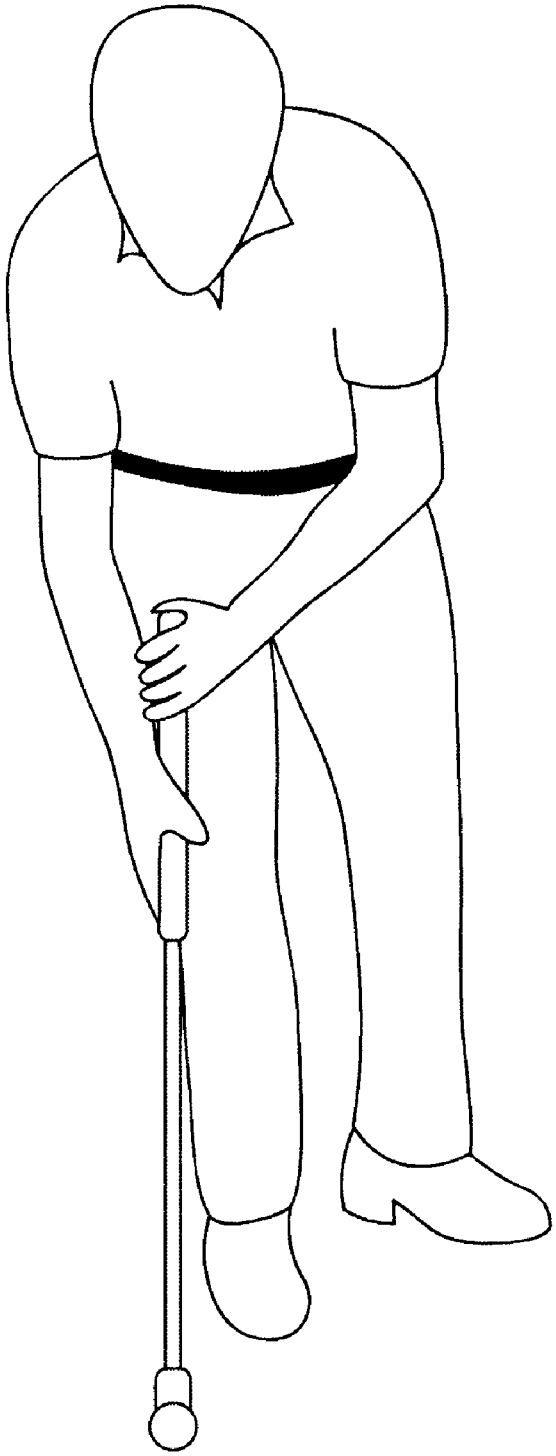

A golfer who putts from a sidesaddle stance using a face of a conventional putter finds it difficult, if not impossible, to place his hands in the vertical plane of the ball and the hole, as shown in FIG. 9A. By rotating the putter to use its toe, the golfer's hands are brought into the vertical plane of the ball and the hole, as shown in FIG. 9B. Because the putter is symmetrical, it can be used by either right handed or left handed golfers with equal facility. The symmetrical shape of the block putter head also enhances the accuracy of the putter in putting with the toe, since the center of mass is lined up with the vertical plane of the hands, the ball, and the hole. The added mass makes this putter particularly effective when putting from the fringe, fairway, or rough, or from a sand trap.

Figure 3:
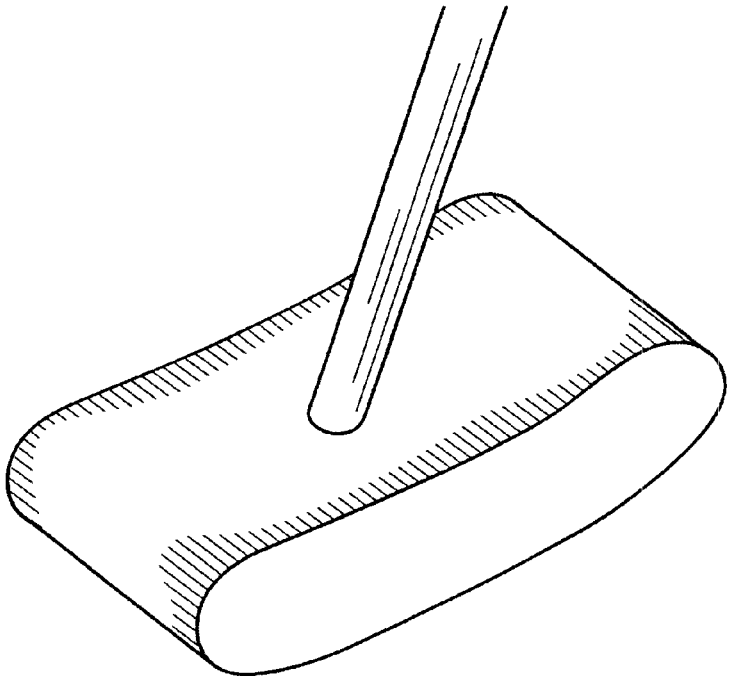
FIG. 3 is a perspective view of a putter head according to the invention.
Figure 4A:
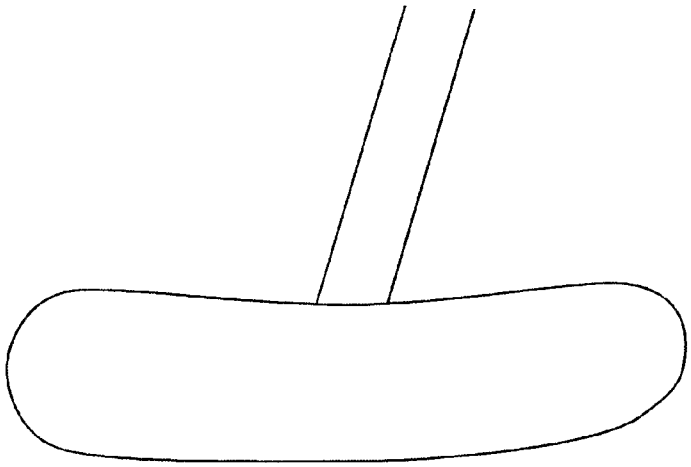
FIGS. 4A and 4B are front and side views of a putter head according to the invention.
Figure 4B:
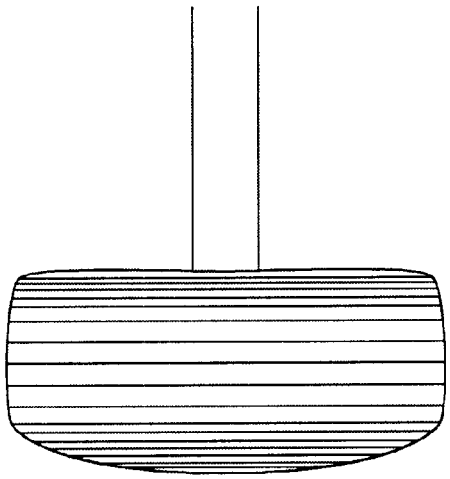

The sole of the putter is preferably biaxially curved, as shown in FIGS. 3 and 4. The curve of the sole helps prevent the putter from digging into the green as the club is pulled back for the backswing before the putt (whether the orientation of FIG. 5A or of FIG. 5B is used). This curvature also makes the putter easier to use when putting from the fringe, fairway, or rough, or from a sand trap. The preferred sole shape will tend to vary from golfer to golfer; some golfers may prefer a flatter sole. The toe of the putter is also preferably curved, as shown in FIGS. 3 and 4.

Figure 10:
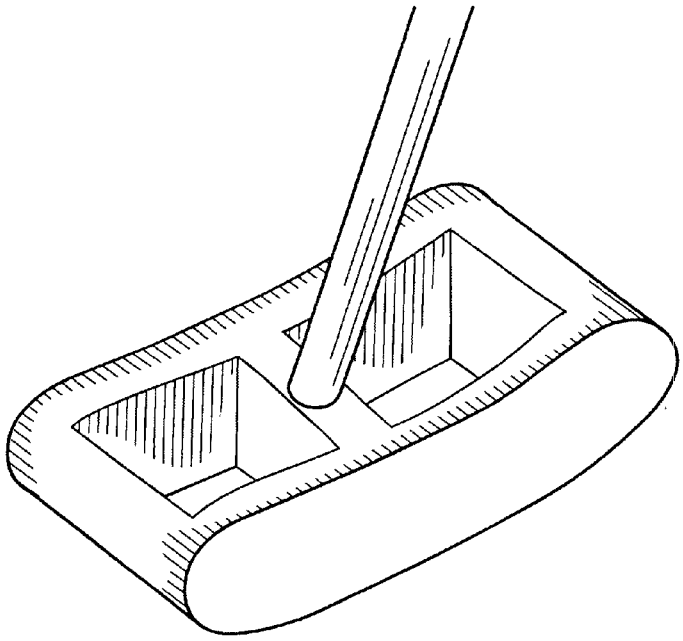
FIG. 10 shows a lightweight block putter head design.

To perfect the sidesaddle putting style, I have found it useful to practice with a traditional thin blade putter but to use a wider putter for competitive play. Using the narrower putter in practice helps train the golfer to hit the center of the ball with the center of the head when putting from the toe. Preferably the practice putter head and the competition putter head are made from different materials so that they may have substantially the same weight despite their different dimensions. This goal may also be achieved by making the competition putter hollow, or by drilling out a solid block. FIG. 10 shows a very lightweight block putter that may be used as the competition putter of a matched pair.

In certain embodiments it may be useful to make the putter head relatively heavy for added stability (e.g., a brass head weighing about 300–500 g). Especially when using a putter with a heavy head and a long shaft, it can be useful to add weight (e.g., about 50–200 g) to the shaft to shift the center of mass upward. I have found that this improves the balance of the putter. While weight can be added in whatever location suits the individual golfer, one particularly useful embodiment involves a weight that moves the center of mass of the combined system of the club and the golfer's swinging arm to (or above) the position of the lower gripping hand. Alternatively, the center of mass of this system can be positioned at the center of mass of the arm alone, or the center of mass of the putter alone can be placed at the position of the lower gripping hand.

EXAMPLE

Figure 11:
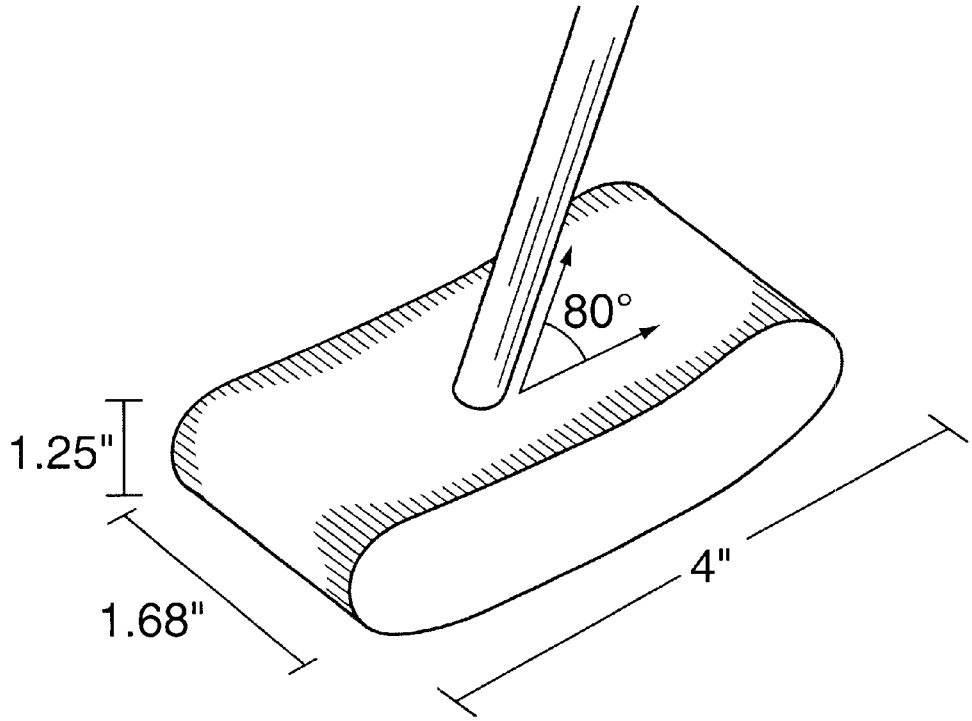
FIG. 11 illustrates the dimensions of a putter head according to the invention.

FIG. 11 shows the dimensions of a particular block putter head according to the invention. This putter head performs well for both conventional and sidesaddle stances. These dimensions are given by way of example only, and may be varied as necessary to suit the needs of a particular golfer. In particular, appropriate widths, as discussed above, vary from about ½ the diameter of a regulation golf ball to about twice the diameter of a regulation golf ball, with widths in the range of ¾ to 1¼ of the diameter of a golf ball being preferred. Lengths may vary from about 3–6 inches, with lengths of about 4–5 inches being preferred. It is also preferred that the length of the putter exceed the width, as required of all clubs by the 2000–01 U.S.G.A. Rules, Appendix II, Part 4b. The putter head should have a height sufficient to reliably strike the ball at a suitable point for putting. Some golfers find that the putter should strike slightly below the equator of the ball, as this can aid the ball in "lifting" out of its position in the grass, which can promote a smooth roll. In the embodiment shown, the putter head is about 1¼ inches high, and heights in the range of about ¾ to 1¾ inches are suitable for practice of the invention.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A method of putting, comprising:

addressing a golf ball in a sidesaddle stance;

swinging a puffer having an elongated shaft; controlling the putter during the putting swing from at least three points of contact, wherein said at least three points of contact comprises;

the contact points of both hands, and the contact point of the shaft on a golfer's shoulder.

2. The method of claim 1 wherein said shoulder contact point occurs at the golfer's shoulder closest to the golf ball during the puffing swing.

3. The method of claim 1 wherein said shoulder contact point occurs at the golfer's shoulder farthest from the golf ball during the putting swing.

4. A putter adapted for use in a sidesaddle stance, comprising:

a head having a sole and an impact face;

an elongate strait shaft attached to the head; and at least two separate grips disposed on said shaft wherein two of said grips are each located closer to a center of the shaft than to either ends of said shaft;

wherein the elongated shaft extends beyond a golfer's shoulder, and wherein the putter is configured such that the shaft passes in front of said rests upon said golfer's shoulder during a pendulum putting stroke on a horizontal surface in which, at bottom of said pendulum stroke;

a center line of the sole is substantially parallel with said surface;

the impact face has a loft being substantially zero degrees;

the shaft is in a plane substantially perpendicular to a target line and the shaft is at an angle of between 10 and 45 degrees with a vertical plane containing the target line.

5. The putter of claim 4 wherein said golfer's shoulder comprises the shoulder closest to a golf ball during the putting stroke.

6. The putter of claim 4 wherein said at least one grip comprises two grips disposed on the elongated shaft, wherein each grip is accessible by a golfer's hands during the putting stroke.

7. The putter of claim 4 wherein said at least one grip comprises two grips disposed on the elongated shaft, wherein one grip is accessible by a golfer's hands and one grip is situated to rest on said golfer's shoulder during the putting stroke.

8. The putter of claim 4 wherein said golfer's shoulder comprises the shoulder farthest from a golf ball during the putting stroke.

9. A matched pair of putters, comprising:

a practice putter, comprising a first substantially symmetric head disposed at an end of a first elongated shaft, wherein the first head has a width less than about 0.84 inch; and a competition putter, comprising a second substantially symmetric head disposed at an end of a second elongated shaft, wherein the second head has a width in the range of about 0.84 inch to about 3.36 inches, wherein the practice putter and the competition putter have substantially the same center of mass and substantially the same radius of gyration about a shoulder of a golfer holding either putter in address position.

10. The matched pair of putters of claim 9, wherein the first head and the second head have substantially equal weights.

11. The matched pair of putters of claim 9, wherein the second head has a width in the range of about 1.26 to about 2.10 inches.

12. The matched pair of putters of claim 9, wherein the second head has a width of about 1.68 inches.

13. The matched pair of putters of claim 9, wherein the first head and the second head have substantially the same cross section in a vertical plane.

14. The matched pair of putters of claim 9, wherein the first head and the second head have substantially the same shape but for width.

* * * * *

UNITED STATES PATENT AND TRADEMARK OFFICE

CERTIFICATE OF CORRECTION

PATENT NO. : 6,595,867 B2
DATED : July 22, 2003
INVENTOR(S) : Howard Sosin

It is certified that error appears in the above-identified patent and that said Letters Patent is hereby corrected as shown below:

Column 7,
Line 4, the words "elongate strait shaft" should be replaced with -- elongated straight shaft --.

Signed and Sealed this

Twenty-third Day of September, 2003

JAMES E. ROGAN
*Director of the United States Patent and Trademark Office*